US011969034B1

(12) United States Patent
McCusker et al.

(10) Patent No.: US 11,969,034 B1
(45) Date of Patent: Apr. 30, 2024

(54) INTEGRATED PROTECTIVE KNEE PAD ASSEMBLY

(71) Applicant: U.S. Government as Represented by the Secretary of the Army, Natick, MA (US)

(72) Inventors: Kathryn L McCusker, Uxbridge, MA (US); Robert E Drown, Wilmington, MA (US); Matthew J Hurley, Framingham, MA (US); Alfredo Lujan, Suffolk, MA (US)

(73) Assignee: Government of the United States as Represented by the Secretary of the Army

( * ) Notice: Subject to any disclaimer, the term of this patent is extended or adjusted under 35 U.S.C. 154(b) by 82 days.

(21) Appl. No.: 17/511,622

(22) Filed: Oct. 27, 2021

Related U.S. Application Data

(62) Division of application No. 16/385,064, filed on Apr. 16, 2019, now Pat. No. 11,191,309.

(51) Int. Cl.
*A41D 13/06* (2006.01)
*A41D 13/05* (2006.01)

(52) U.S. Cl.
CPC ..... *A41D 13/0575* (2013.01); *A41D 13/065* (2013.01)

(58) Field of Classification Search
CPC ..... A41D 13/055; A41D 13/0556; A41D 13/0562; A41D 13/0568; A41D 13/065; A41D 13/0575; A41D 13/0153; A41D 13/0005; A63B 71/1225; A63B 71/2071; A63B 71/125
USPC ..... 2/1, 22–24, 62, 455, 911
See application file for complete search history.

(56) References Cited

U.S. PATENT DOCUMENTS

| | | | | | |
|---|---|---|---|---|---|
| 5,652,956 | A * | 8/1997 | Hoshizaki | A63B 71/1225 | 2/22 |
| D402,424 | S * | 12/1998 | Jackson | A41D 13/0575 | D29/122 |
| 6,374,408 | B1 * | 4/2002 | Tomlinson | A41D 13/0568 | 2/22 |
| D678,621 | S * | 3/2013 | Saranga | D29/121.1 | |
| 11,191,309 | B1 * | 12/2021 | McCusker | A41D 13/0575 | |
| 2006/0107433 | A1 * | 5/2006 | Olson | A63B 71/08 | 2/22 |

FOREIGN PATENT DOCUMENTS

| | | | | |
|---|---|---|---|---|
| CA | 2931819 | A1 * | 11/2013 | A41D 13/015 |
| WO | WO-9418861 | A1 * | 9/1994 | A41D 13/065 |

* cited by examiner

*Primary Examiner* — Jameson D Collier
(74) *Attorney, Agent, or Firm* — Timothy M. Barlow

(57) ABSTRACT

A knee pad assembly includes a protective member, a hard shell member and a hinge member connecting the protective member and the hard shell member. A first end of the hard shell member is connected to the hinge member. A second end of the hard shell member opposing the first end has an upper lip member and a lower lip member, the upper lip member and the lower lip member defining a recessed member that extends from one side of second end of the hard shell member to another side of the second end of the hard shell member.

11 Claims, 12 Drawing Sheets

INTEGRATED PROTECTIVE KNEE PAD ASSEMBLY

STATEMENT OF GOVERNMENT INTEREST

The invention described herein may be manufactured and used by or for the U.S. Government for governmental purposes without the payment of any royalties thereon or therefor.

FIELD

The aspects of the present disclosure relate generally to the field of protective garments, and in particular to a knee protection system that includes a protective knee pad device for use in a suitably configured pant garment.

BACKGROUND

Kneepads or knee pads are essential equipment for users engaged in activities requiring contact of the knees with the ground or other surfaces. The different types of knee pads include those that are worn directly on the knee and others that are attached to the pants.

Garment-mounted pads are often more comfortable, and the hard shell of the pad worn on the exterior of the garment fabric serves to extend the life of the garment itself. For pocket type knee protectors, the pad itself can be washed separately. However, if foreign objects are inserted into the pocket, the wearer must open the pocket and take out the pads and the foreign objects.

Accordingly, it would be desirable to provide a knee pad device and system for use in a pant garment that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a knee pad device or assembly for use with a pant garment, such as a military style combat pant. In one embodiment, the knee pad assembly includes a protective member, a hard shell member and a hinge member connecting the protective member and the hard shell member. A first end of the hard shell member is connected to the hinge member. A second end of the hard shell member, opposing the first end, has an upper lip member and a lower lip member. The upper lip member and the lower lip member define a retaining groove member that extends from one side of second end of the hard shell member to an other side of the second end of the hard shell member.

In one embodiment, the retaining groove member defines an opening that is configured to receive a portion of a pant panel inserted into the recessed member.

In one embodiment, the hard shell member comprises a furrowed portion at the first end, the furrowed member configured to flex when a force is applied to the hard shell member.

In one embodiment, a width the furrowed portion of the first end is less than a width of the second end of the hard shell member.

In one embodiment, a second end of the furrowed member at the connection with the hinge member is greater than the width of the first end of the furrowed member.

In one embodiment, the protective member comprises a foam pad.

In one embodiment, an inner surface of the hard shell member comprises a fastener member that is configured to connect with a complementary fastener member on an outer surface of the protective member.

In one embodiment, the hard shell member is configured to close over and lock to a top surface of the protective member.

In one embodiment, the hinge member is configured to enable the hard shell member to move from an open unlocked state to a closed locked state on the top surface of the protective member.

According to another aspect, the disclosed embodiments are directed to a knee protection system that includes a pant garment and a knee protection device that can be inserted into a sleeve portion of the pant garment. In one embodiment, a pant leg of the pant garment has an upper welt defining an upper opening into the pant leg and a lower welt defining a lower opening into the pant leg. The knee protection device is a knee pad assembly that is configured to be inserted into the upper opening defined by the upper welt. The knee pad assembly includes a protective member, a hard shell member, and a hinge member connecting the protective member and the hard shell member. The hard shell member has a first end and a second end, the second end opposing the first end. The first end of the hard shell member is connected to the hinge member. The second end of the hard shell member opposing the first end of the hard shell member has an upper lip member and a lower lip member. The upper lip member and the lower lip member define a retaining groove member that extends from one side of the second end of the hard shell member to an other side of the second end of the hard shell member.

In one embodiment, an edge portion of the lower welt is configured to be inserted into an opening defined by the retaining groove member of the hard shell member.

In one embodiment, a first end of the protective member is configured to be inserted into the upper opening defined by the upper welt, a second end of the protective member connected to the hinge member.

In one embodiment, the hard shell member is configured to be folded on top of an upper pant member of the upper welt.

In one embodiment, the hard shell member has a fastener member on an inner side of the hard shell member, the fastener member configured to engage a complementary fastener member on an outer surface of the protective member through the lower opening defined by the lower welt.

In one embodiment, a panel of the pant leg is disposed between the hard shell member and the protective member.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 1:
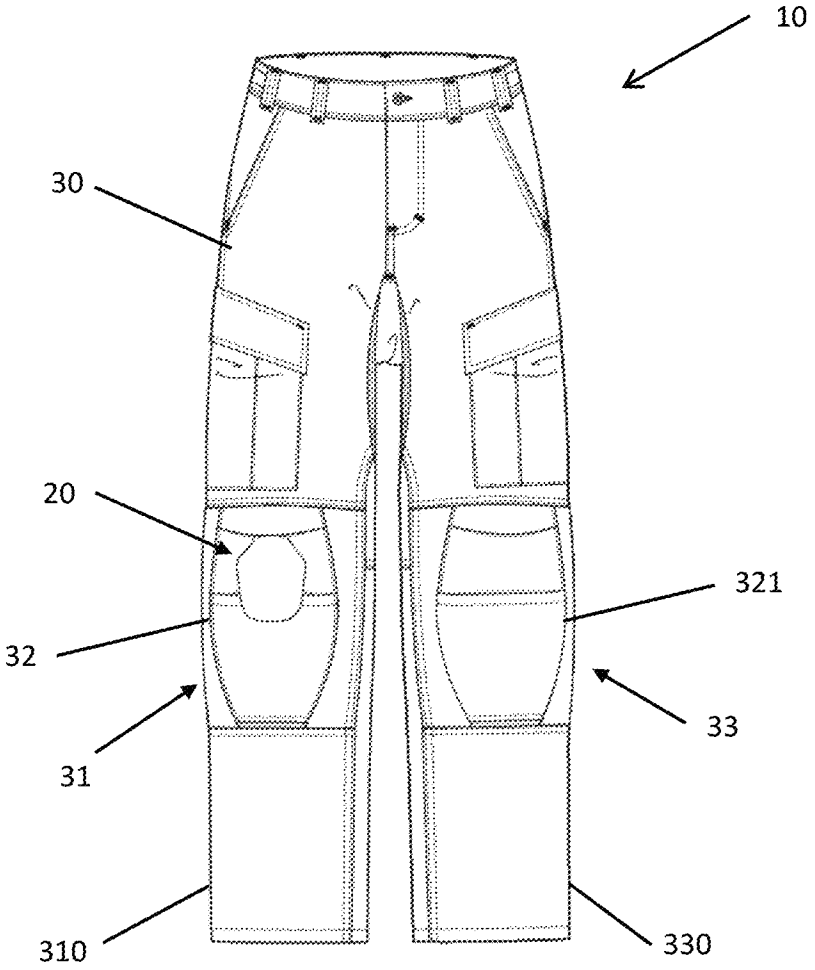
FIG. 1 illustrates a front view of a pant system and protective knee pad device incorporating aspects of the disclosed embodiments.

Referring to FIG. 1, one embodiment of knee protection system 10 incorporating aspects of the disclosed embodiments is illustrated. The aspects of the disclosed embodiments relate to the knee protection system 10 that includes a protective knee pad device or assembly 20 for use in a suitably configured pant garment 30.

In one embodiment, the aspects of the disclosed embodiments are directed to an integrated protective knee pad device or assembly 20 for a pant garment 30, such as the Army Combat Pant. While the aspects of the disclosed embodiments will generally be described herein with respect to use with the Army Combat Pant, the aspects of the disclosed embodiments are not so limited. In alternate embodiments, the integrated protective knee pad device (generally referred to herein as "protective knee pad device") of the disclosed embodiments can be used with any suitable pant garment in a variety of different applications that require knee protection. These can include for example, but not limited to, recreation, construction, outdoor enthusiast, hunting, military, security and law enforcement.

In the example of FIG. 1, the protective knee pad device 20 is shown inserted into or integrated with knee portion 31 of the pant garment 30. As shown in FIG. 1, the protective knee pad device 20 is shown inserted into a sleeve or sleeved member 32 of the right pant leg member 310. The sleeved member 32 generally corresponds to or is disposed on an area of the pant garment 30 where the knee of the wearer will be located when the pant garment is donned in a use position.

Figure 2:
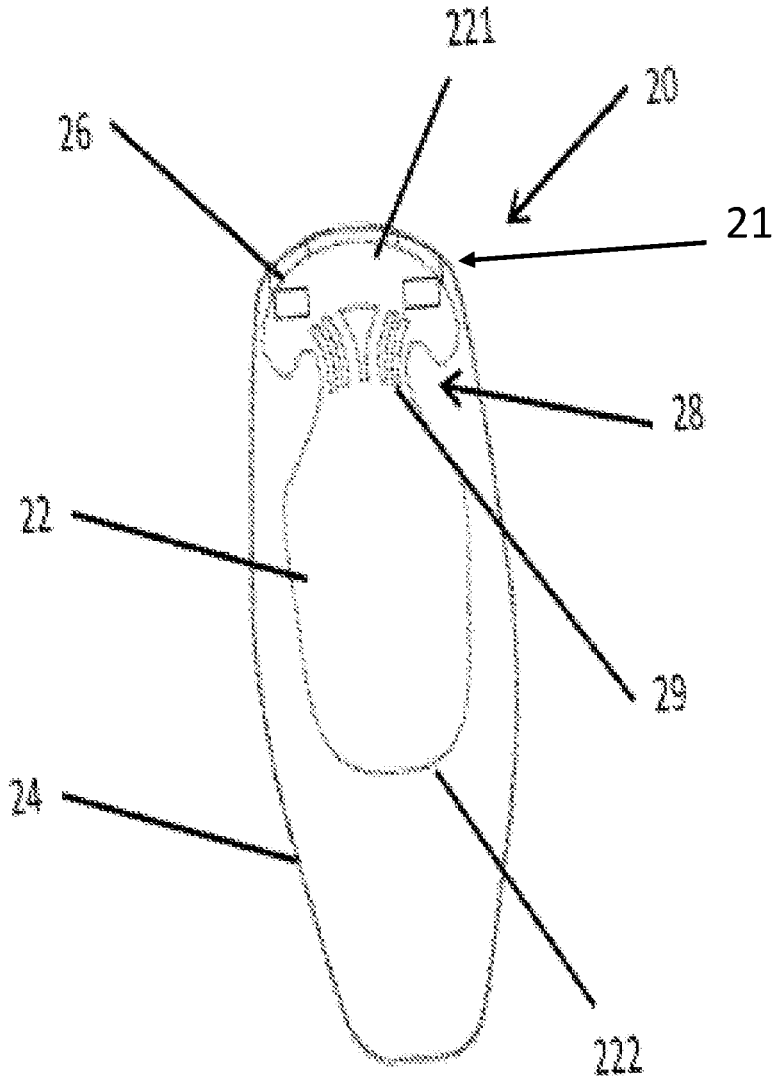
FIG. 2 illustrates a front view of a protective knee pad device and assembly incorporating aspects of the disclosed embodiments in a closed state.

In one embodiment, the sleeved member 32 is a separate fabric piece or panel member that is disposed on top of and is secured to a fabric of the right pant leg member 310. As is illustrated in FIG. 2, the sleeved member 32 can be attached to the pant leg member 310 by suitable stitching 201-204. The stitching 201-204 shown in FIG. 2 is merely exemplary and any suitable stitching can be used or implemented to secure the sleeved member 32 to the corresponding portions of the pant garment 30.

While the aspects of the disclosed embodiments are generally described herein with respect to only one pant leg, it will be understood that aspects of the disclosed embodiments described herein will equally apply to the other leg of the pant garment 30. For example, a sleeve member 321 including the features of the sleeve member 32, can be disposed in or on the knee area of left pant leg member 330 and can also be configured to receive a protective knee pad device 20 incorporating aspects of the disclosed embodiments.

Figure 3:
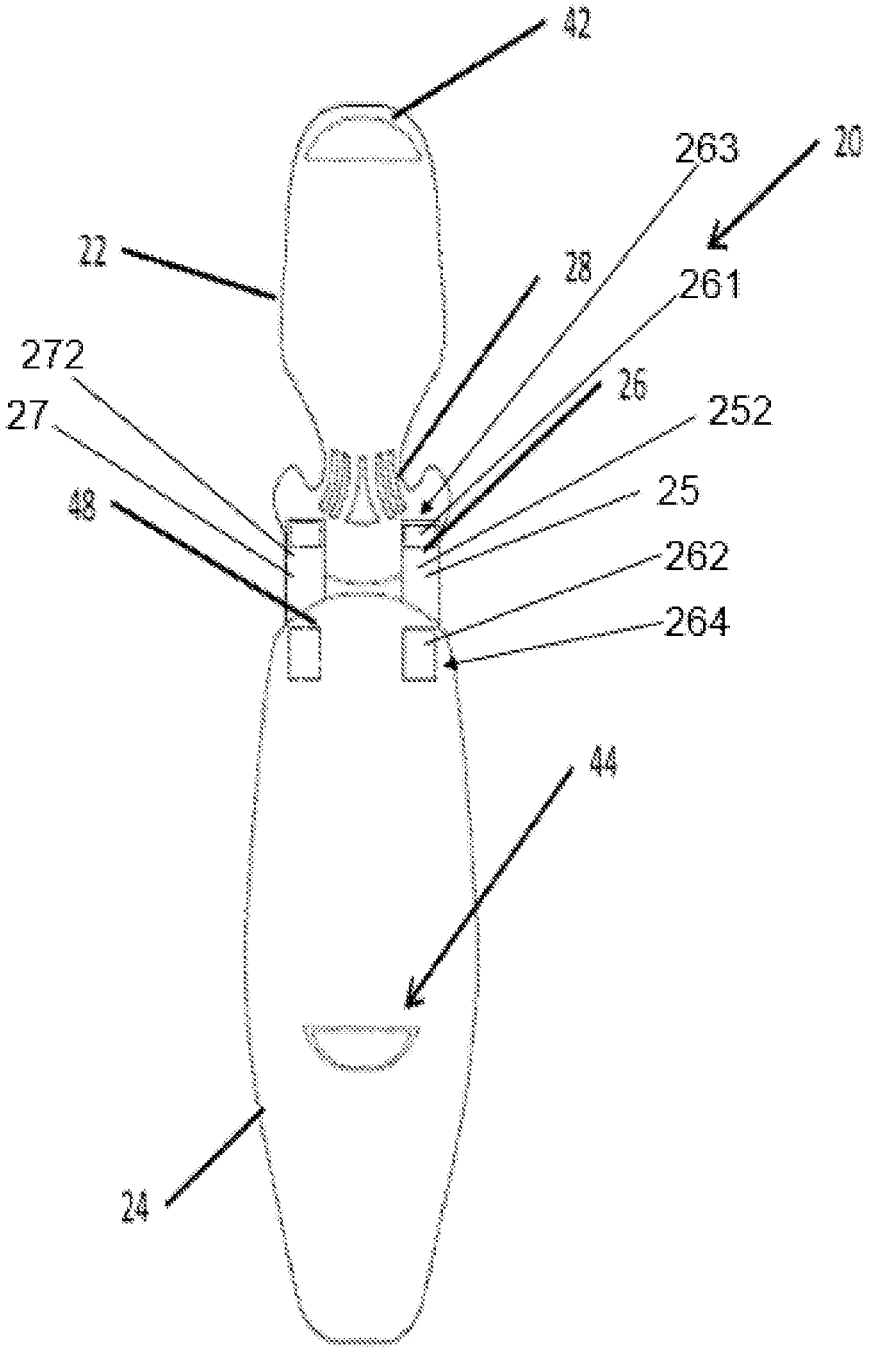
FIG. 3 illustrates the protective knee pad device of FIG. 2 in a closed state.

FIG. 2 illustrates a front view of the knee pad device 20 in the closed state. In this example, the hard shell member 22 is folded down over the protective insert 24. The open state is when the hard shell member 22 is moved or flipped away from the protective insert, such as shown in FIG. 3. One or more hinge member(s) 26 enables the hard shell member 22 to move from the open state to the closed state and from the closed state to the open state.

Referring also to FIG. 3, in one embodiment, the hinge member 26 generally comprises a flexible narrow strap 25, 27 or other suitable material that can be used to connect together the hard shell member 22 and the protective insert 24. In one embodiment, the material of the hinge member 26 generally comprises a woven tape. In the example of FIG. 3, the hinge member 26 is two (2) lengths of grosgrain (straps 25, 27), creating two hinge points, each length ending at a connection location with the first portion 261 of the hinge member 26 coupling to a front side of the protective member/insert 24 and a second portion 262 of the hinge member 26 coupling to a back side of the hard shell member 22 (strap 27 includes the same features as strap 25) (see e.g. location 48) on the protective insert 24. The connection locations 48 may include a first fastening member 264 integrated with the protective member 24 and a second fastening 263 integrated with the hard shell member 22. When the hinge first portion 261 and the hinge second portion 262 are stacked against one another, the first fastening member 264 and the second fastening member 263 are configured to be secured directly together. The hinge member 26 comprises a first strap 25 and a second strap 27 about parallel to one another, and the first strap 25 and the second strap 27 are physically separate from one another. Although two hinge points are illustrated in the example of FIG. 3, the aspects of the disclosed embodiments are not so limited. The particular arrangement, material and number of hinge points formed by the hinge member 26 can be adapted to the particular conditions and requirements. For example, in one embodiment, the hinge member 26 comprises a single member and hinge point. Another alternative is three or more hinge members that form a corresponding number of hinge points. In one embodiment, the hinge member 26 can be a single strip of material that runs from one side to the other side to form a continuous and single hinge point along both sides of the hinge.

As shown in FIGS. 2 and 3, the hard shell member 22 includes a furrowed portion 28. The furrowed portion 28 generally comprises a series of spaced apart hollowed or trenched members 29. The members 29 generally extend or are disposed longitudinally from the first end 221 of hard shell member 22 toward the second end 222 of the hard shell member 22. In the example of FIG. 2, the furrowed portion 28 includes five members 29. In alternate embodiments, the furrowed portion 28 can include any number of members 29, other than including five. The furrowed portion 28 is configured to provide flexibility and limited movement for the hard shell member 22 when a force is applied, such as when kneeling, sitting and crawling.

In one embodiment, a material of the hard shell member 22 comprises a thermoplastic elastomer or other suitable material. The material of the protective insert 24 generally comprises a closed cell foam. In one embodiment, the protective insert 24 is a foam pad member.

FIG. 3 illustrates the knee pad assembly 20 in the open state. In this example, the underside of the hard shell member 22 includes a fastening member 42. The fastening member 42 is configured to be attached and secured to a corresponding or complementary fastening member 44 on the protective insert 24. In one embodiment, the fastening members 42 and 44 comprise complementary parts of a hook and loop fastener system. Although the aspects of the disclosed embodiments are described herein with respect to a hook and loop fastener system, the aspects of the disclosed embodiments are not so limited. In alternate embodiments the fastening members 42, 44 can be part of any suitable type of fastening or closure system, such as snap or magnet fasteners, for example.

Figure 4:
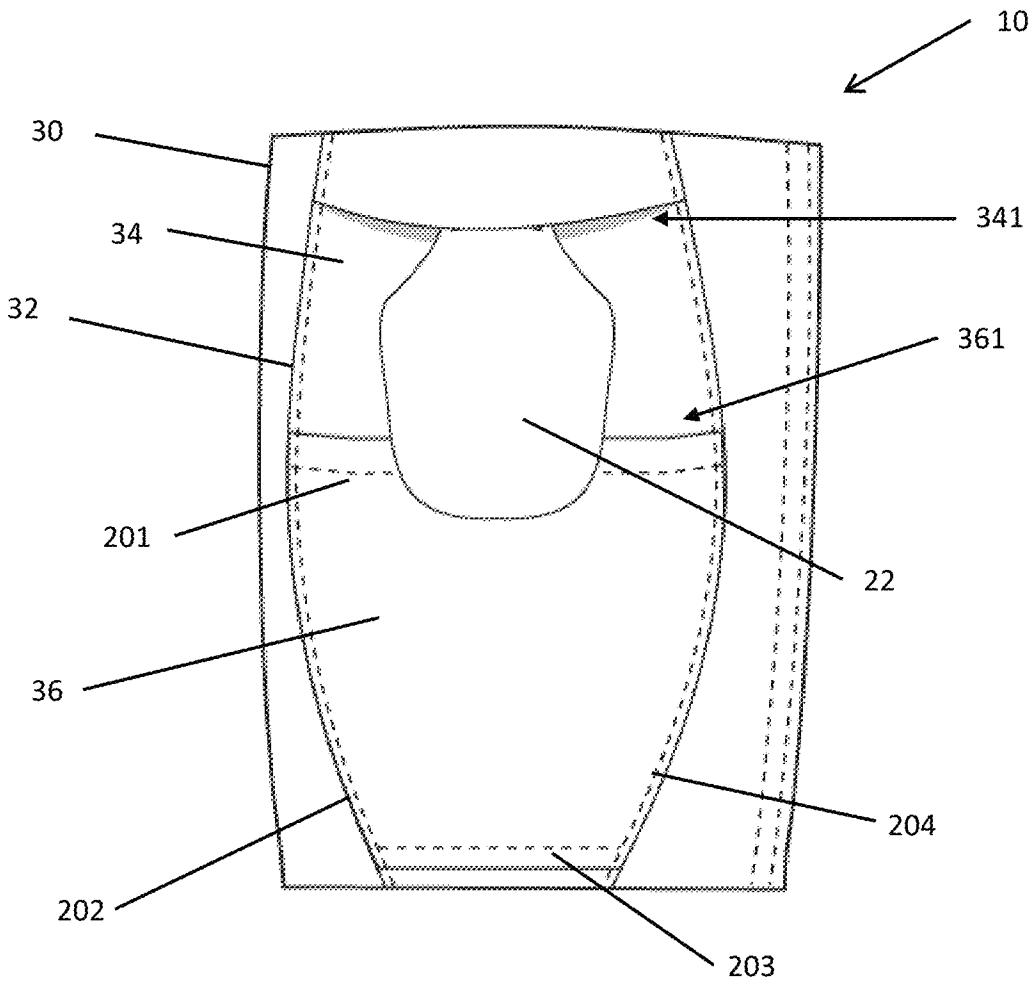
FIG. 4 illustrates the protective knee pad device of FIG. 2 in an open state.

Referring to FIGS. 1 and 4, the protective knee pad device or assembly 20 is shown disposed in a use state or position, with the protective knee pad device 20 inserted into or received in sleeve 32 of the right leg 310 of the pant garment 30. The sleeve 32 in the knee area of the right pant leg 310 of the pant 30 of the disclosed embodiments provides what is referred to herein as a two welt opening placed in parallel.

Figure 5:
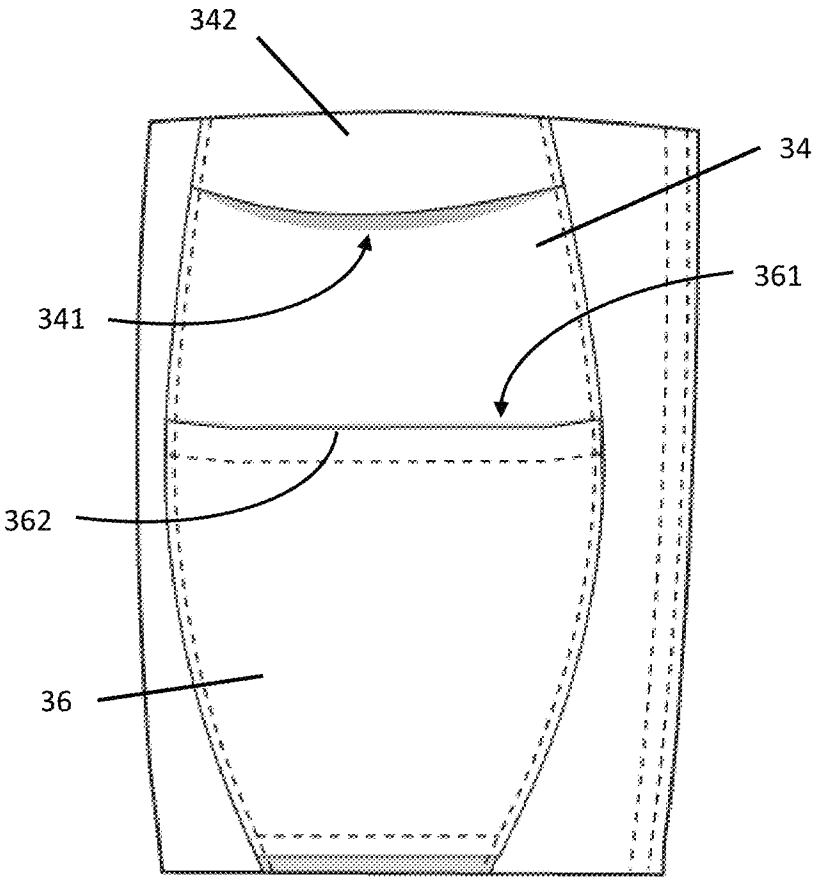
FIG. 5 illustrates a knee/sleeve portion of an exemplary pant garment configured for the protective knee pad device of the disclosed embodiments.
Figure 6:
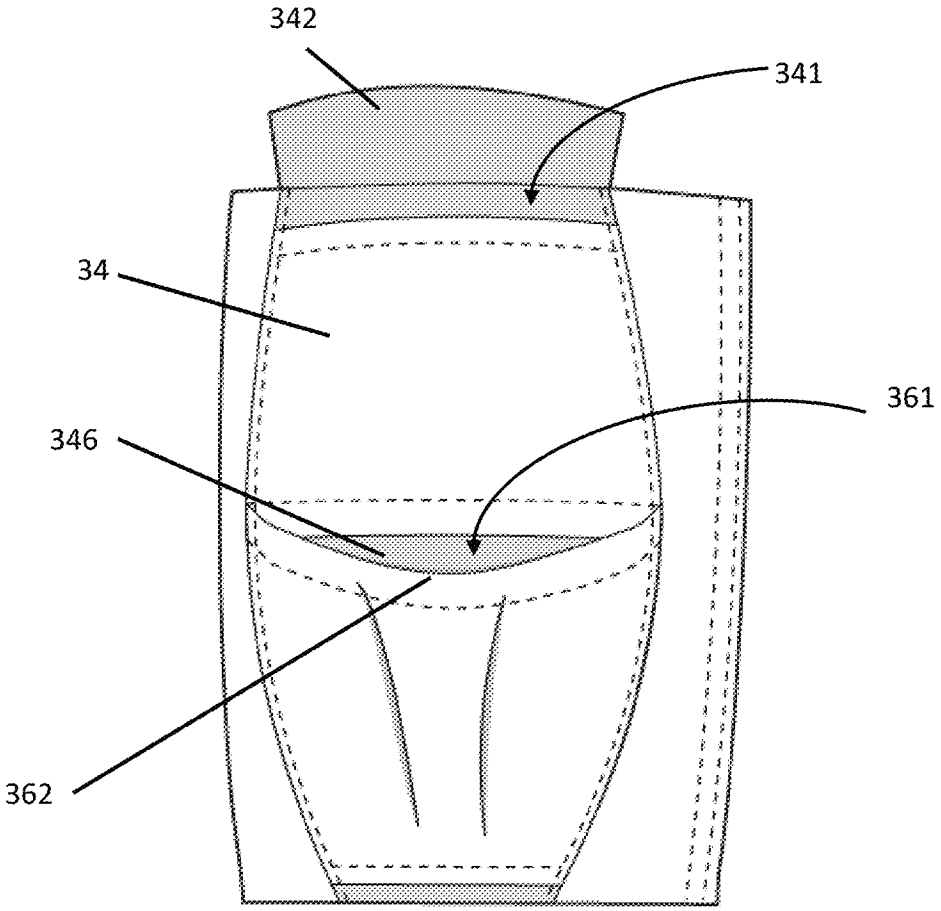
FIG. 6 illustrates the knee portion of an exemplary pant garment configured for the protective knee pad device of the disclosed embodiments.

Referring also to FIGS. 5 and 6, the two welt opening generally comprises an upper panel or welt 34 defining an upper opening 341 and a lower panel or welt 36 defining a lower opening 361. The two welt opening creates a pass through that allows a protective insert 24 of the knee pad device 20 shown in FIG. 2 to be inserted into the upper opening 341. As described further below, the lower opening 361 allows the hard shell member 22 on the outside of the garment to be secured to the protective insert 24 within the sleeve portion.

As shown in the example of FIG. 4, a hard shell member 22 of the protective knee pad device 20 is configured to be fastened down over the outer surface or fabric portions of the sleeve 32 of the pant garment 30. The protective insert 24 is disposed under a corresponding portion of the outer surfaces of the sleeve 32 of the pant garment 30. When the hard shell member 22 is flipped down to the fastened state, the protective insert 24 is configured to be locked to the pant garment 30. The lower opening 361 defined by the lower welt 36 of the pant garment 30 is configured to allow the hard shell member 22 of the knee pad device 20 to be secured directly to the protective insert 24.

FIG. 5 illustrates the sleeve member 32 of the pant garment 30 that is configured to receive the knee pad device 20 of the disclosed embodiments. The sleeve or sleeved member 32 described herein can be the same for either the right leg member or left leg member of the pant garment 30. Referring also to FIG. 6, the sleeve member 32 in this example shows the opening 341 defined by the upper welt 34 and the opening 361 defined by the lower welt 36.

As will be described further herein, to insert the protective knee pad device 20 into the sleeve member 32, a flap member 342 is pulled back to expose the opening 341 between the upper welt 34 and an inner pant member 346, shown in FIG. 6. Similarly, the lower welt 34 is shown in FIG. 6 pulled away from the inner pant member 346 to define the opening 361. In one embodiment, the opening 361 is configured to allow the fastener 42 on the hard shell member 22 shown in FIG. 3 to connect to the fastener 44 on the protective insert 24 of the protective knee pad device 20.

In one embodiment, as is further described herein, an edge of the hard shell member 22 is configured to engage an edge member 362 of the lower welt 36 to further secure the knee pad assembly 20 in place as well as prevent debris from collecting or otherwise interfering with the knee pad device 20 and pant garment 30.

Figure 7:
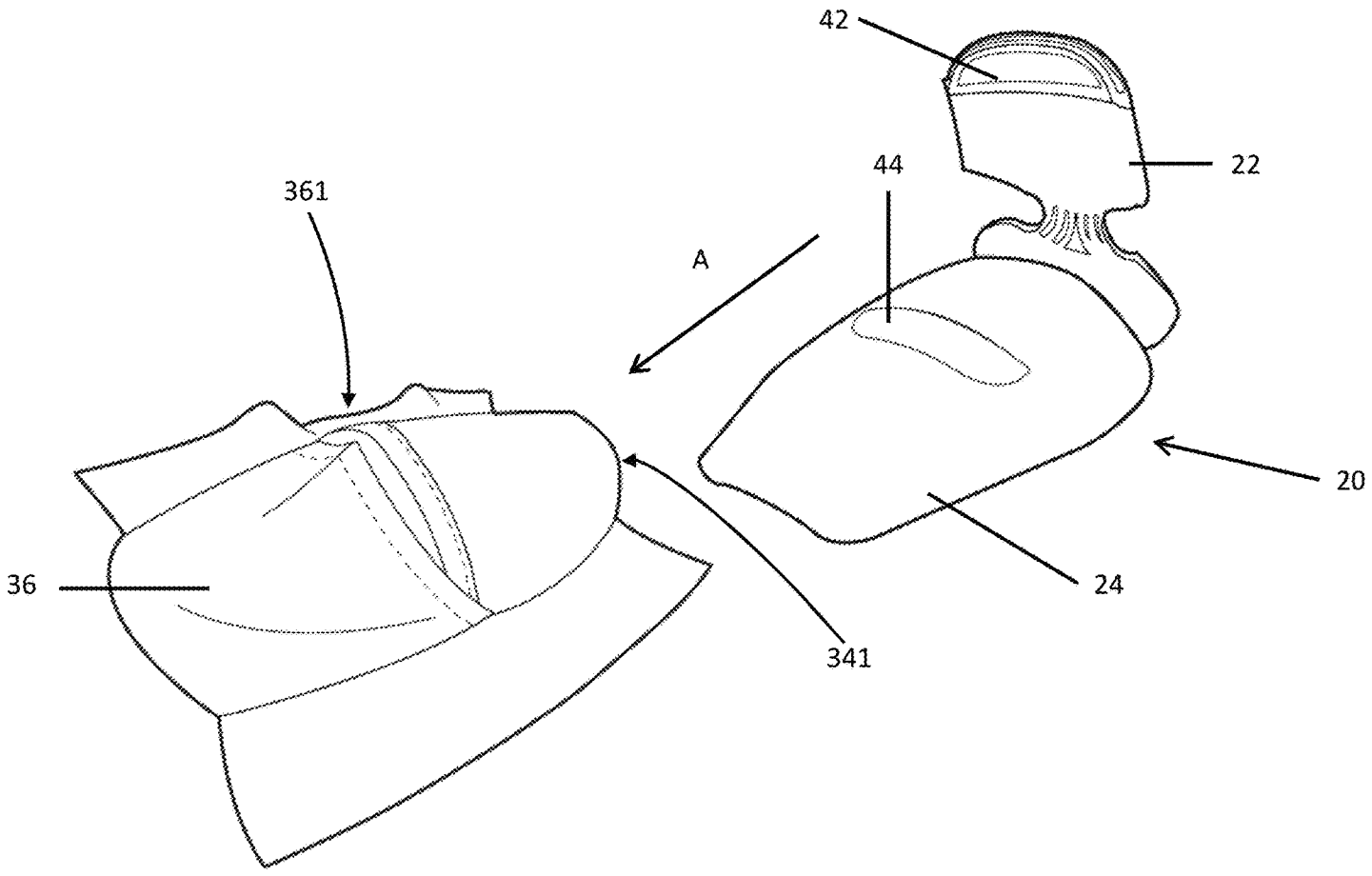
FIGS. 7-9 illustrates the insertion process of a protective knee pad device incorporating aspects of the disclosed embodiments into the corresponding pocket of an exemplary pant garment.

FIGS. 7-10 illustrate an example of how the knee pad device 20 is inserted into the sleeve 32 of the pant leg 310 (or pant leg 330) of a suitably configured pant garment 30. As shown in FIG. 7, the protective knee pad device 20 is in an open state, meaning that the hard shell member 22 is flipped up or disposed away from the protective insert 24. The protective member 24 of the protective knee pad assembly 20 is moved in the direction A and into the opening 341 defined by the upper welt 34.

Figure 8:
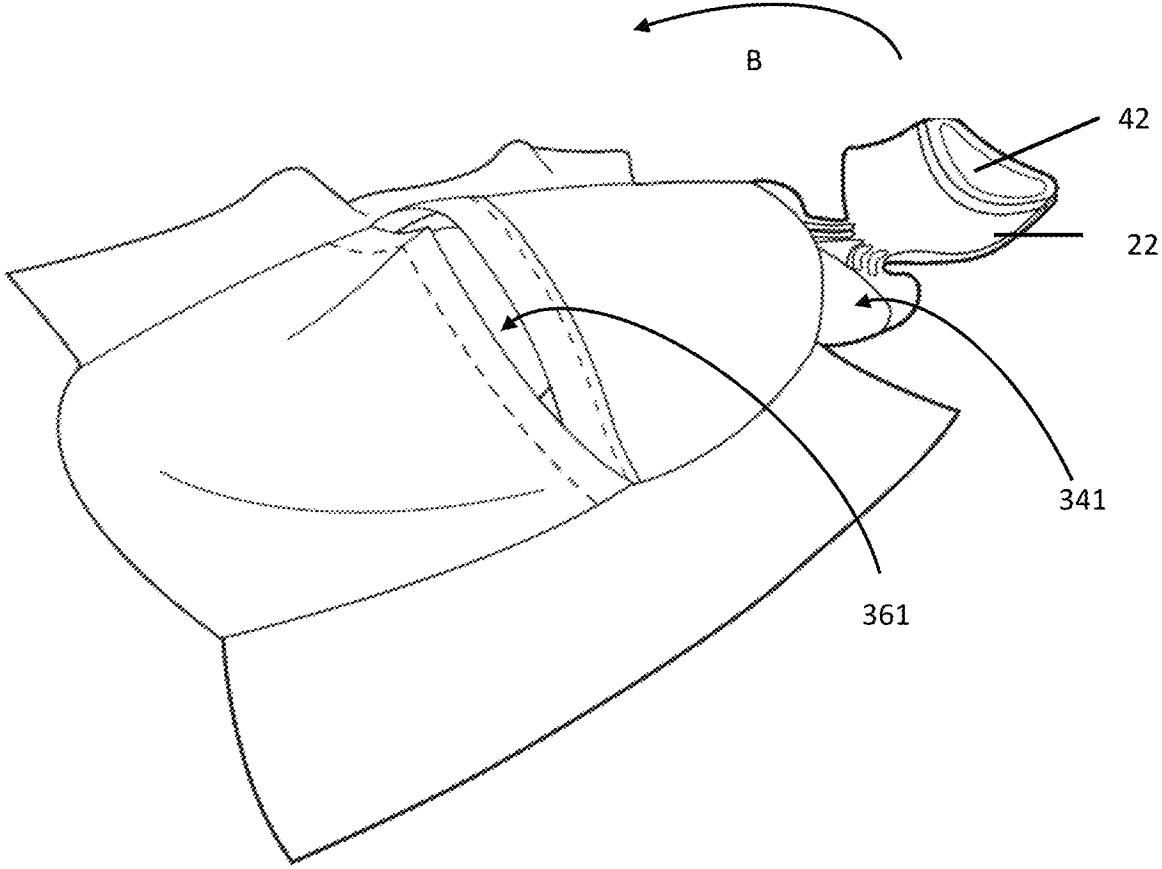

FIG. 8 shows the protective member 24 inserted into the opening 341. The opening 361 defined by the lower welt 36 is in the open state in this example. Once the protective member 24 is inserted into the opening 341, the hard shell member 22 can be moved or rotated in the direction of arrow B so as to secure the hard shell member 22 against or on top of the upper welt 34. As the hard shell member 22 is moved or rotated in the direction of arrow B, the hinge member 26 of the knee pad assembly 20 is configured to lock the hard shell member 22 against the protective member 24, with the upper welt 34 at least partially therebetween.

Figure 9:
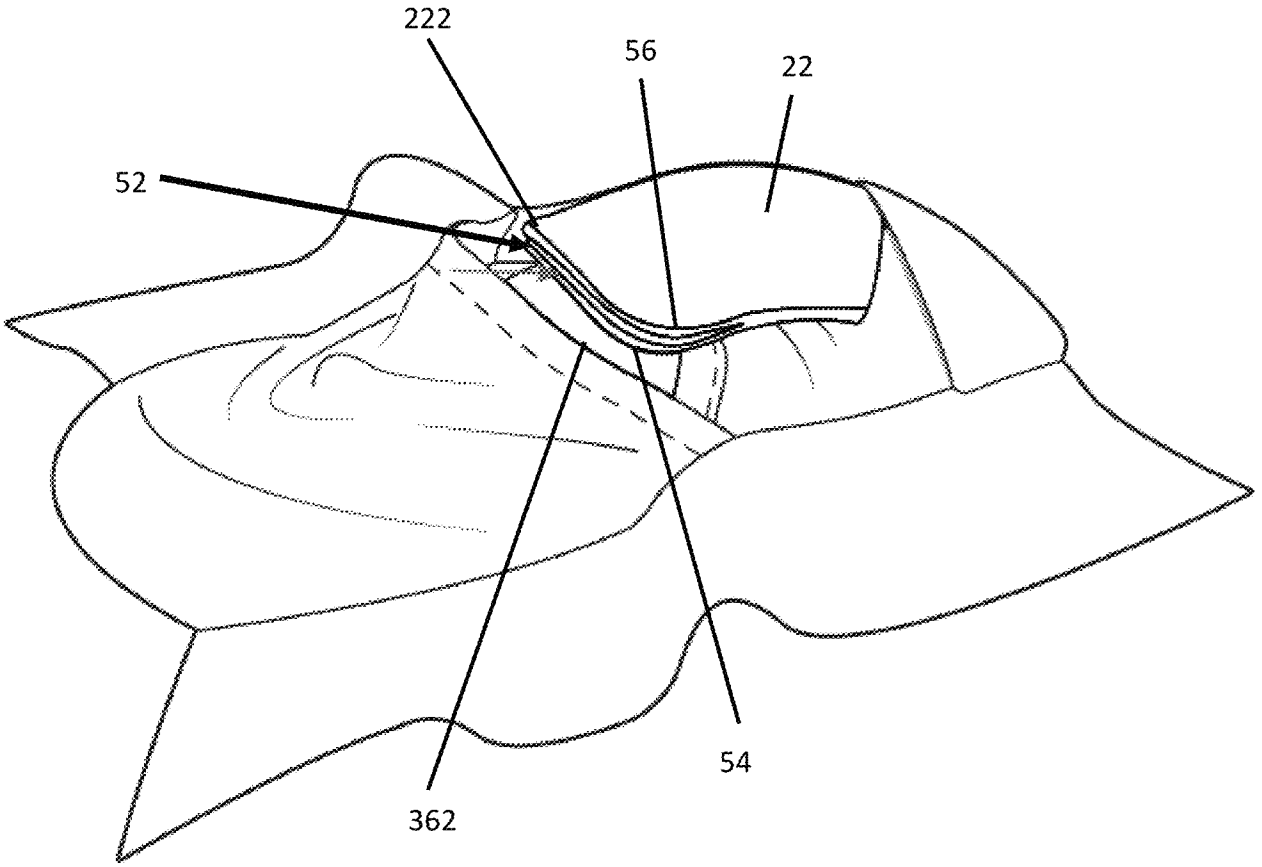

As shown in FIG. 9, in one embodiment, the fastener member 42 of the hard shell member 22 will engage the corresponding fastener member 44 of the protective member 24 through the opening 361. In this manner, the hard shell member 22 is more securely fastened to the protective member 24. In one embodiment, the opening 361 allows the fastener members 42, 44 to be secured directly together.

In one embodiment, referring to FIG. 9, an edge of the hard shell member 22 is configured to engage an edge member 362 of the lower welt 36 to further secure the knee pad assembly 20 in place as well as prevent debris from collecting or otherwise interfering with the knee pad device 20 and pant garment 30.

As shown in FIG. 9, in one embodiment, the second end 222 of the hard shell member 22 of the knee pad assembly 20 includes a retaining groove or grooved member 52, also referred to herein as an opening or recess. The retaining groove member 52 is configured to receive an edge member or portion 362 of the lower welt 36 and retain the edge member 362 in a secure manner. In this manner, debris can be prevented from entering into the pant member. The retaining groove member 52 can include one or more grooved portions.

In this example, the second end 222 of the hard shell member 22 can include a lower lip member 54 and an upper lip member 56. The lower lip member 54 and the upper lip member 56 define the opening or recess that forms the grooved portion of the retaining groove member 52. The retaining groove member 52 is configured to receive the edge member 362 of the lower welt 36. In one embodiment, the depth of the grooved portion of the retaining groove member 52 can be on the order of approximately one and one-quarter inches (1¼"), while the width of the retaining groove member 52 (from one side to the other side) can be on the order of approximately three and seven-eighths inches (3-⅞") inches. The area of the edge member 362 of the lower welt 36 is suitably sized and dimensioned to be received in the retaining groove or opening of the retaining groove member 52. The retaining groove member 52 has a width about perpendicular from an axis that extends from one side of second end 222 of the hard shell member 22 to another side of the second end 222 of the hard shell member 22, wherein the retaining groove member 52 has a depth about perpendicular with a plane that comprises the axis and the width.

While the opening of the retaining groove member 52 is referred to herein as a groove or recess, the aspects of the disclosed embodiments are not so limited. In alternate embodiments, the opening or recess formed by the retaining groove member 52 can have any suitable shape and size to receive, engage and secure the edge member 362. When engaged, the edge member 362 of the lower welt 36 is sandwiched into the retaining groove member 52 between the lower lip member 54 and the upper lip member 56. In this manner, scooping of the lower welt 36 is prevented, which helps in keeping debris out.

Figure 10:
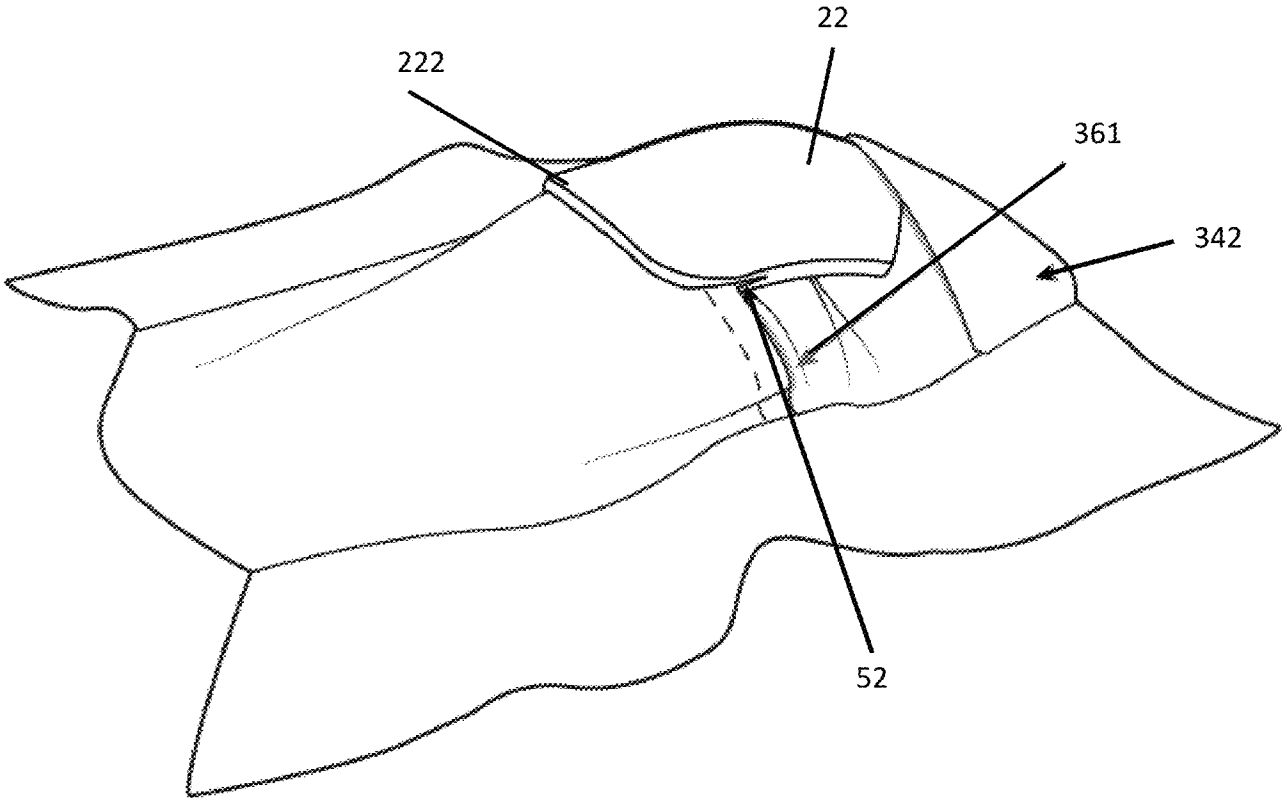
FIG. 10 illustrates a protective knee pad device incorporating aspects of the disclosed embodiments inserted into the knee area of a suitably configured pant garment.

FIG. 10 illustrates the knee pad assembly 20 fully integrated to the sleeve 32 of the pant garment 30. The top flap 342 of the upper welt 34 is flipped down and rests on a top portion of the hard shell member 22. The edge member 362 is engaged in the retaining groove member 52 of the hard shell member 22.

Figure 11:
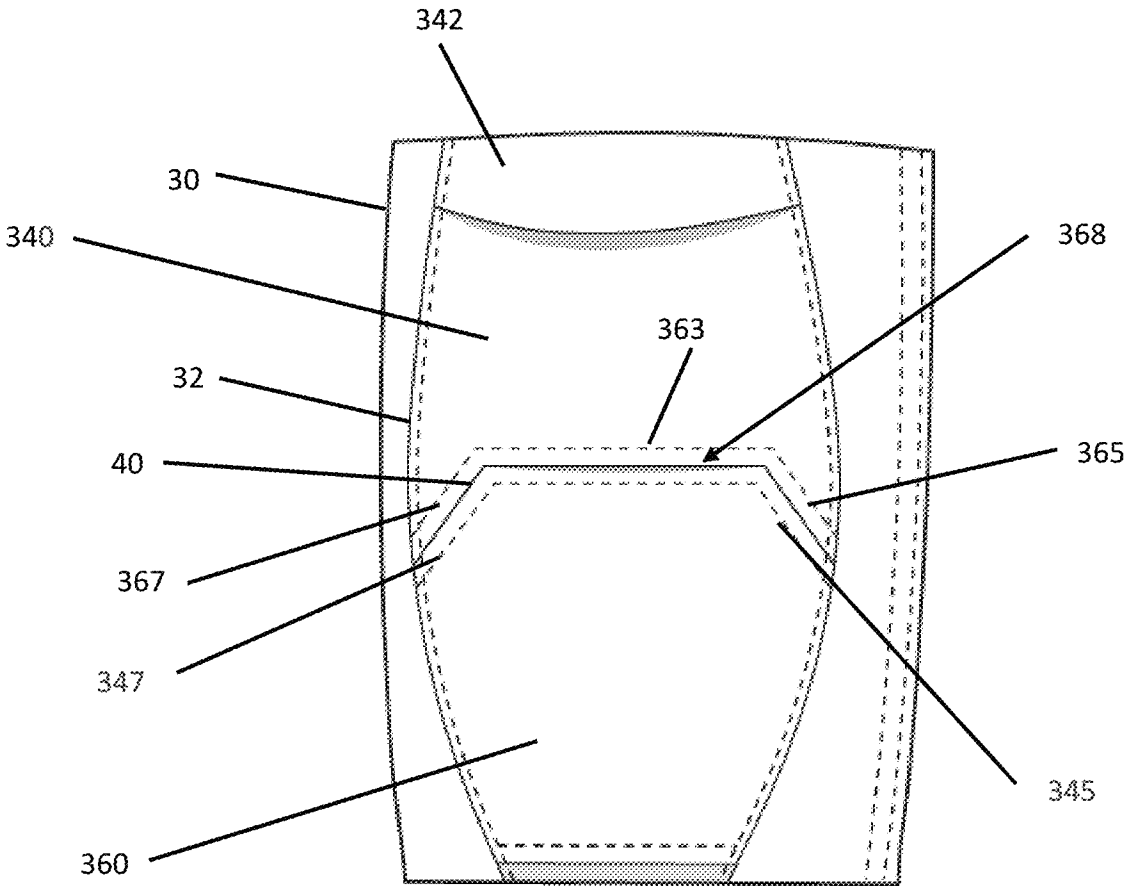
FIG. 11 illustrates a knee/sleeve portion of another exemplary pant garment configured for the protective knee pad device of the disclosed embodiments.
Figure 12:
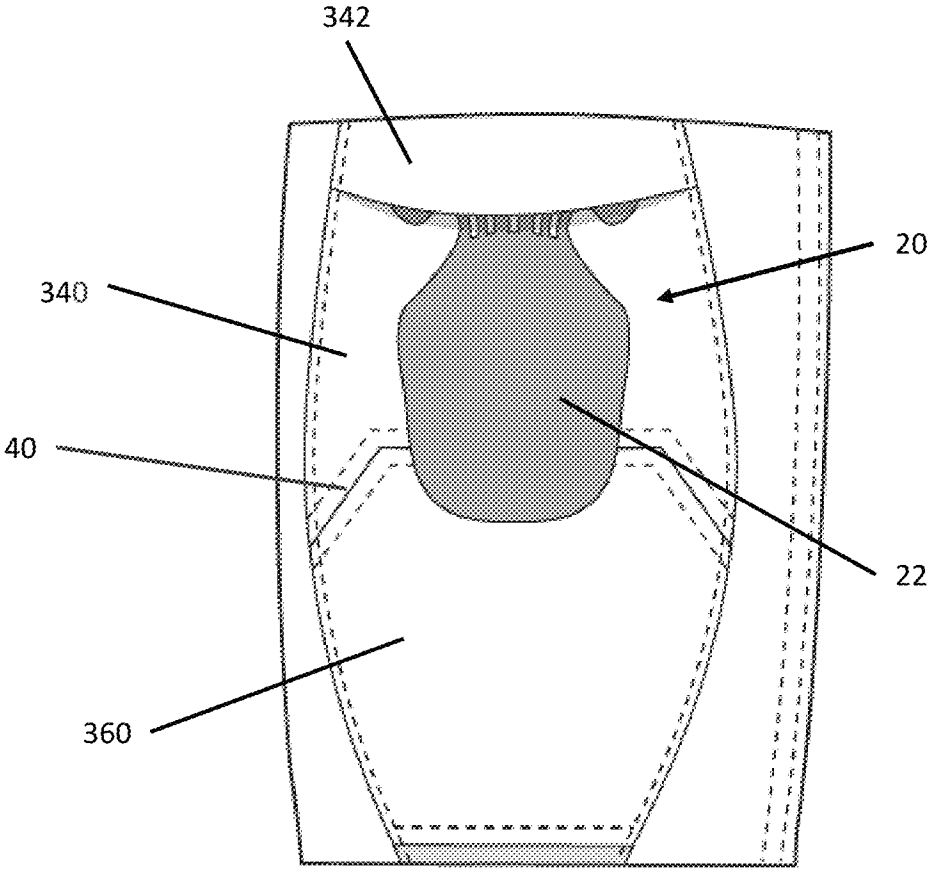
FIG. 12 illustrates the protective knee pad device of the disclosed embodiments inserted into the sleeve portion of the pant garment illustrated in FIG. 11.

FIGS. 11 and 12 illustrate another example of a knee pad sleeve that can be used with the knee pad assembly 20 of the disclosed embodiments. The design of the lower welt 360 and upper welt 340 in FIG. 11 is different from the design of the lower welt 36 and upper welt 34 shown in FIG. 5. In the alternative example of FIG. 11, the end segments 365 and 367 of lower welt 360 and the end segments 345 and 347 of upper welt 340 are angled downward relative to a middle segment 363 and sewn together.

Also, in the example of FIG. 11, the upper welt 340 and the lower welt 360 portions of the sleeve member 32 are connected together by a seam 40. The seam 40 defines an opening 368, such as the opening 362 referred to above. The seam 40 and angling of the lower welt 360 is this example does not affect how the knee pad assembly 20 functions or integrates with the sleeve member 32 of the pant garment.

The aspects of the disclosed embodiments provide to an integrated protective knee pad device or assembly for a pant garment, such as the Army combat pant. The protective knee pad device is configured to be inserted into a suitable opening or pocket of the pant garment when needed for use. When not needed, the protective knee pad device can be readily removed from the pant garment. In this manner, the pant garment can be more flexible and comfortable when knee protection is not needed.

The design of the knee pad device and the corresponding opening in the pant garment provide a number of advantages over the state of the art. Some of these include, but are not limited to, protection from impact and abrasion and scalable levels of protection by either having or removing the knee pad device from pant garment. The knee pad device of the disclosed embodiments also provides the ability to insert and remove the knee pad device while donning the pant garment.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A knee pad assembly, comprising:

a protective member;

a unitary hard shell member;

a hinge member connecting the protective member and the unitary hard shell member;

a first end of the unitary hard shell member connected to the hinge member and a second end of the unitary hard shell member opposing the first end of the unitary hard shell member, the second end comprising an upper lip member and a lower lip member, the upper lip member and the lower lip member defining a retaining groove member that extends from one side of second end of the unitary hard shell member to another side of the second end of the unitary hard shell member, wherein a first portion of the hinge member couples to the protective member on a front side of the protective member, and wherein a second portion of the hinge member couples to the unitary hard shell member on a back side of the unitary hard shell member.

2. The knee pad assembly of claim 1, wherein the retaining groove member defines an opening that is configured to receive an edge member of a pant panel insertable into the retaining groove member.

3. The knee pad assembly of claim 1, wherein the unitary hard shell member comprises a furrowed portion comprising a series of spaced apart hollowed members disposed longitudinally from the first end toward the second end of the unitary hard shell member.

4. The knee pad assembly of claim 1, wherein the unitary hard shell member comprises a thermoplastic elastomer.

5. The knee pad assembly of claim 1, wherein the hinge member comprises a first fastening member integrated with the protective member and a second fastening member integrated with the unitary hard shell member.

6. The knee pad assembly of claim 1, wherein the retaining groove member has a width perpendicular from an axis that extends from one side of the second end of the unitary hard shell member to another side of the second end of the unitary hard shell member, wherein the retaining groove member has a depth perpendicular with a plane that comprises the axis and the width.

7. The knee pad assembly of claim 1,
wherein the hinge member comprises a first strap and a second strap parallel to one another,
wherein the first strap creates a first hinge point,
wherein the second strap creates a second hinge point, and
wherein the first strap and the second strap are physically separate from one another.

8. A knee pad assembly, comprising:
a protective member;
a unitary hard shell member comprising a first end and a second end; and
a hinge member connecting the protective member and the unitary hard shell member;
wherein the first end of the unitary hard shell member is connected to the hinge member,
wherein the second end of the unitary hard shell member opposes the first end,
wherein the second end of the unitary hard shell member comprises an upper lip member and a lower lip member,
wherein the upper lip member and the lower lip member define a retaining groove member that extends from one side of second end of the unitary hard shell member to another side of the second end of the unitary hard shell member,
wherein the unitary hard shell member comprises a thermoplastic elastomer,
wherein a first portion of the hinge member couples to the protective member on a front side of the protective member, and
wherein a second portion of the hinge member couples to the unitary hard shell member on a back side of the unitary hard shell member.

9. The knee pad assembly of claim 8,
wherein the retaining groove member defines an opening that is configured to receive an edge member of a pant panel that is insertable into the retaining groove member.

10. A joint pad assembly, comprising:
a unitary hard shell member comprising a first end and a second end;
a protective member;
wherein the unitary hard shell member is coupled to the protective member,
wherein the second end of the unitary hard shell member opposes the first end,
wherein the second end of the unitary hard shell member, along an edge of the depth, comprises an upper lip member and a lower lip member,
wherein the upper lip member and the lower lip member define a retaining groove member that extends from one side of the second end of the unitary hard shell member to another side of the second end of the unitary hard shell member;
a hinge member connecting the protective member and the unitary hard shell member, the first end of the unitary hard shell member connected to a first portion of the hinge member,
wherein the unitary hard shell member comprises a furrowed portion comprising a series of spaced apart hollowed members disposed longitudinally from the first end toward the second end of the unitary hard shell member, and
wherein the hinge member comprises a first fastening member integrated with the protective member and a second fastening member integrated with the unitary hard shell member.

11. The joint pad assembly of claim 10,
wherein the hinge member comprises a first strap and a second strap parallel to one another,
wherein the first strap creates a first hinge point,
wherein the second strap creates a second hinge point, and
wherein the first strap and the second strap are physically separate from one another.

* * * * *